US005588858A

United States Patent [19]

Lester et al.

[11] Patent Number: 5,588,858

[45] Date of Patent: Dec. 31, 1996

[54] CONNECTOR SYSTEM WITH WEDGE AND GROMMET RETAINER

[75] Inventors: Lester J. Lester, Signal Mill; Gary N. Van Trump, Santa Ana, both of Calif.

[73] Assignee: ITT Corporation, Santa Ana, Calif.

[21] Appl. No.: 404,894

[22] Filed: Mar. 15, 1995

[51] Int. Cl.[6] ..... H01R 13/52

[52] U.S. Cl. ..... 439/275; 439/555

[58] Field of Search ..... 439/559, 555, 439/557, 556, 548, 566, 587, 589, 274, 275, 279

[56] References Cited

U.S. PATENT DOCUMENTS

| | | | |
|---|---|---|---|
| 2,872,655 | 2/1959 | Damon | 419/552 |
| 3,404,364 | 10/1968 | Paullus | 439/458 |
| 3,439,312 | 4/1969 | Greasley | 409/555 |
| 3,569,909 | 3/1971 | Garver | 439/353 |
| 3,573,716 | 4/1971 | Garver | 439/557 |
| 3,651,446 | 3/1972 | Sadogierski | 439/357 |
| 3,745,514 | 7/1973 | Brishka | 439/848 |
| 3,772,637 | 11/1973 | Paullus et al. | 439/589 |
| 3,920,304 | 11/1975 | Bromberg | 439/274 |
| 3,994,552 | 11/1976 | Selvin | 439/278 |
| 4,220,385 | 9/1980 | Luca, Jr. | 439/589 |
| 4,241,967 | 12/1980 | Collins | 439/589 |
| 4,274,702 | 6/1981 | Buck | 439/589 |
| 4,402,566 | 9/1983 | Powell | 439/589 |
| 4,492,421 | 1/1985 | Ito | 439/271 |
| 4,676,575 | 6/1987 | Denlinger | 439/271 |
| 4,734,057 | 3/1988 | Noschese | 439/589 |
| 4,767,350 | 8/1988 | Cooper | 438/271 |
| 5,249,982 | 10/1993 | Funk et al. | 439/556 |
| 5,259,788 | 11/1993 | Nishimura | 439/565 |
| 5,299,949 | 4/1994 | Fortin | 439/275 |
| 5,310,364 | 5/1994 | Hooper | 439/724 |

*Primary Examiner*—Neil Abrams
*Assistant Examiner*—Barry Matthew L. Standig
*Attorney, Agent, or Firm*—Thomas L. Peterson

[57] ABSTRACT

A connector system is provided wherein each connector (12, 16, FIG. 2 ) has a grommet retainer (102, 120) that retains a grommet (100, 114) at the rear of the connector, and wherein when the connectors are mated they securely hold a first connector within a mounting wall. Each connector has a retainer lying rearward of a grommet and having a plurality of retainer holes (104) that pass wires that extend through the grommet, the retainer having walls which engage the grommet to retain it and assure proper orientation of the retainer so the holes of the retainer and grommet are aligned. A first connector (12) which can be inserted into a hole (30) of a mounting wall (14), has resilient tines (36, 38) that press against the hole surface and that have latch parts (56) at their front ends that form shoulders (60) that engage a face (34) of the wall. The second connector has a plurality of wedges (42, 44) that each move immediately inward of a corresponding tine as the connectors move together for mating, to prevent the tines from being radially inwardly deflected, to thereby lock the first connector to the mounting wall.

9 Claims, 8 Drawing Sheets

CONNECTOR SYSTEM WITH WEDGE AND GROMMET RETAINER

BACKGROUND OF THE INVENTION

One type of connector has contacts with mating ends at a front end of the connector housing, and has electrical wires extending rearwardly from the contacts and out of the rear end of the connector. A grommet lies at the rear of the housing and has holes through which the wires pass. The grommet is formed of soft elastomeric material to seal against the wires and keep out moisture. For smaller connectors, the grommet can be held in place by cold rolling plastic walls of the housing to retain the periphery of the grommet. However, for larger connectors, it would be desirable if middle portions of the grommets were retained, at least when the grommet expanded. It also would be desirable if wires extending rearwardly from the grommets could be guided so they do not move too far to one side and leave openings through which moisture can enter through the grommet holes.

A first connector of a pair of mating connectors, often has to be mounted on a mounting wall, such as a thick casing wall of an engine. It is possible to use latches in the form of resilient tines that snap into position, but there is danger that the latches could come loose. A system which enabled a first connector to be securely fixed to a mounting wall by moving the first connector along its axis into a hole in the mounting wall and by mating a second connector to the first one, would be of value.

SUMMARY OF THE INVENTION

In accordance with one embodiment of the present invention, a connector and connector system are provided which reliably secure an elastomeric grommet in one or both connectors and which reliably secures a first connector to a mounting wall when the connectors are mated. The grommet is secured by a grommet retainer mounted rearward of the grommet. The retainer has a plurality of retainer holes that pass wires extending through grommet passages, and the retainer has walls lying between its retainer holes that engage the grommet. The walls that engage the grommet can be in the form of posts projecting forwardly from a plate-like portion of the retainer, with the posts being received in blind holes at the rear end of the grommet. The same grommet can have posts projecting in a first pattern from its forward face, and in a second pattern from its rear face, and the same grommet can be used for receptacle or plug connectors whose hole patterns are mirror images of each other.

The first connector of a pair of mating connectors, has at least one tine with a rearwardly-facing shoulder at its free forward end for abutting a face of the mounting wall. The second connector has a wedge that moves into a position radially inward of the tine to prevent its inward deflection when the connectors are mated. The wedge moves inward of the tine before the contacts of the two connectors are mated.

The novel features of the invention are set forth with particularity in the appended claims. The invention will be best understood from the following description when read in conjunction with the accompanying drawings.

DESCRIPTION OF THE PREFERRED EMBODIMENT

Figure 1:
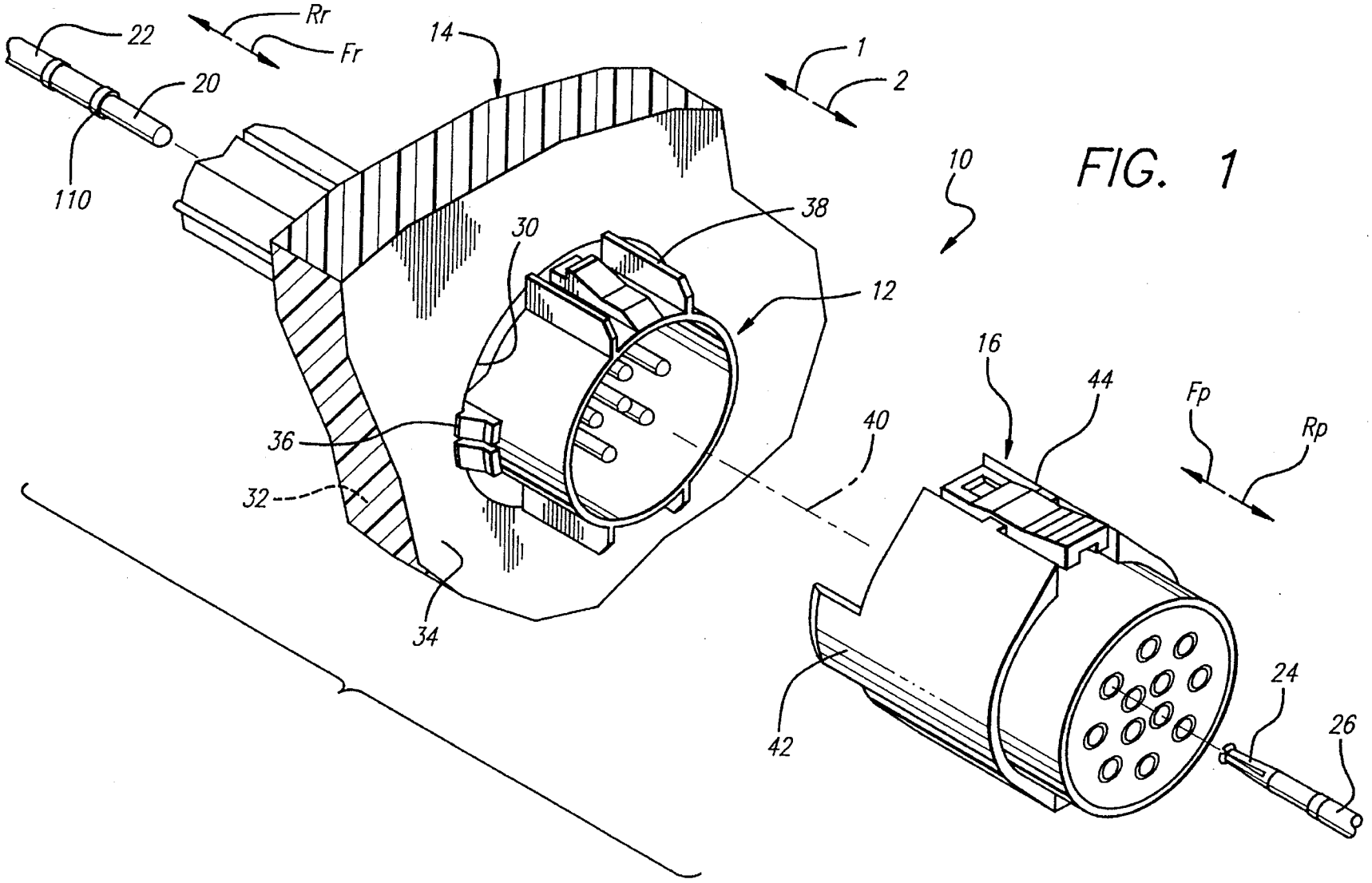
FIG. 1 is an exploded isometric view of a connector system constructed in accordance with the present invention, showing a first connector installed on a mounting wall, showing a second connector approaching the first one to mate therewith, and showing a pair of contacts and wires extending therefrom for installation in the connectors.

FIG. 1 illustrates a connector system 10 which includes a first or receptacle connector 12 that is installed on a mounting wall 14 and a second or plug connector 16. The particular system was designed for mounting on a casing in a vehicle. The figure also shows a pin contact 20 installed at the end of an insulated wire 22 for mounting in the first connector 12, and a socket contact 24 lying at the end of another insulated wire 26 for mounting in the second connector 16. The mounting wall 14 has a cylindrical hole 30 through which the first connector projects, and has first and second opposite faces 32, 34. The first connector resists pullout by the provision of two sets of tines 36, 38 that engage the second face 34 of the wall. Both connectors lie on an axis 40. When the connectors mate, a pair of wedges 42, 44 on the second connector prevent radially inward deflection of the tines, to prevent removal of the first connector. The first or receptacle connector 12 is installed by moving it in a forward receptacle direction Fr and is removed (with the tines deflected inwardly toward the axis) by moving it in the rearward receptacle direction Rr. The second or plug connector 16 is mated to the first one by moving the second connector in a forward plug direction Fp, and is unmated by moving it in the rearward plug direction Rp. While the forward and rearward directions each relate to a particular connector, first and second directions indicated by arrows 1, 2 are used for both connectors.

Figure 2:
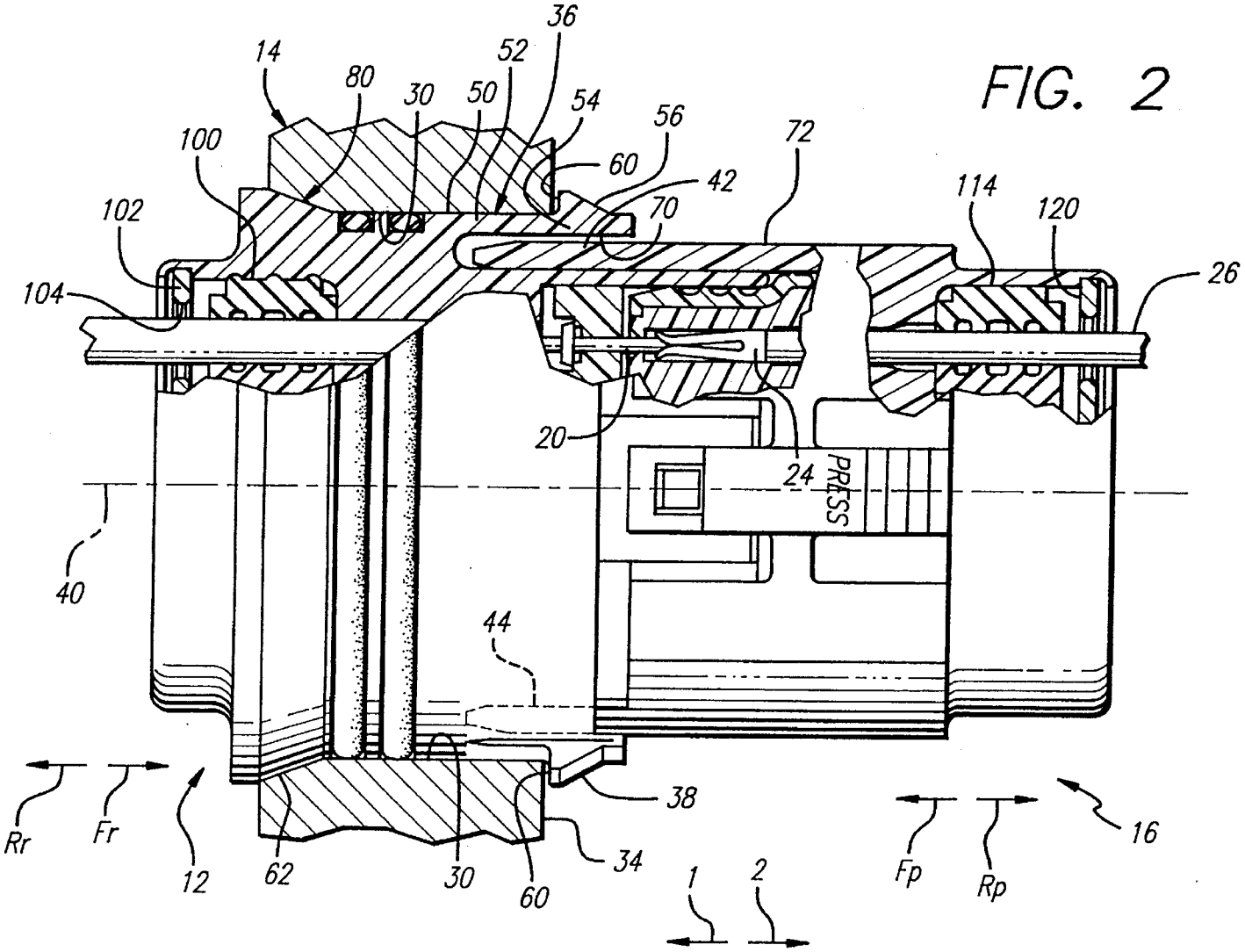
FIG. 2 is a partially sectional side view of the connector system of FIG. 1, with all parts installed and with the connectors fully mated.

As shown in FIG. 2, the first connector 12 has a housing 80 with a main housing portion 50. Each pair of tines 36, 38 has a rear end 52 that is fixed to the main housing portion by being molded integrally with it. Each tine has a forward end 54 that includes a radially outwardly-extending latch part 56. Each latch part has a rearwardly (in direction Rr) facing shoulder 60 for abutting the second face 34 of the mounting wall. As the first connector is installed in the mounting wall 14, the tines are radially inwardly deflected until the shoulders 60 snap outwardly in front of the wall face 34, and thereafter resist rearward movement out of the wall. A partially forwardly-facing abutment 62 at the rear of the first connector, abuts the mounting wall and prevents any further forward movement of the first connector into the wall.

While the substantial abutment of the tine shoulders 60 with the mounting wall will usually prevent rearward removal of the first connector, manufacturers often require a positive lock that would prevent undesired rearward removal of the connector when the two connectors are mated. The wedges 42, 44 prevent accidental removal or substantial connector tilt (if the tines on only one side were inwardly deflected) of the connectors when the first and second connectors are mated. The main housing portion 50 is formed to leave a forwardly opening wedge-receiving space 70 on a radially inward side of each tine such as 36. Each wedge such as 42 projects in the forward direction Fp (direction 1) from a main housing portion 72 of the second connector. As the connectors approach each other to mate, the wedges 42, 44 enter corresponding wedge-receiving spaces 70 and prevent radially inward deflection of the tines. The wedges thereby prevent sufficient inward (toward axis 40) movement of the shoulders 60 to move them inwardly out of abutment with the second wall face 34. Thus, the wedges 42, 44 prevent removal of the first connector from the mounting wall when the connectors are mated.

The wedges 42, 44 also prevent the connectors from mating in the event that the first connector 12 has not been properly installed on the mounting wall so that both of its sets of tines 36, 38 are not in their fully forward positions with their shoulders 60 abutting (lie a small distance forward of face 34) the mounting wall.

It would be possible to provide only one tine 36 or one adjacent set of tines at 36, and fix the opposite latch part so it was not deflectable. However, this would allow the first connector to be mounted in only a thin wall instead of the relatively thick wall 14 illustrated, and also would require considerable tilt of the axis 40 from the axis of the mounting hole 30 during installation or removal. Applicant prefers at least two latches that are spaced at least 90° about the axis.

The wedges such as 42 of the second connector, extend a considerable distance forward (in direction Fp) of the sockets 24 in the second connector. The wedges extend sufficiently forward so they enter the wedge-receiving spaces 70 prior to the pin contacts 20 mating with the socket contacts 24, or before any part of the second connector engages any of the pin contacts 20 on the first connector. As a result, if the first connector 12 is not properly installed in the mounting wall 14, so the wedges cannot enter the wedge-receiving spaces 70, this will prevent any damage to the contact due to the misalignment of the connectors.

Figure 3:
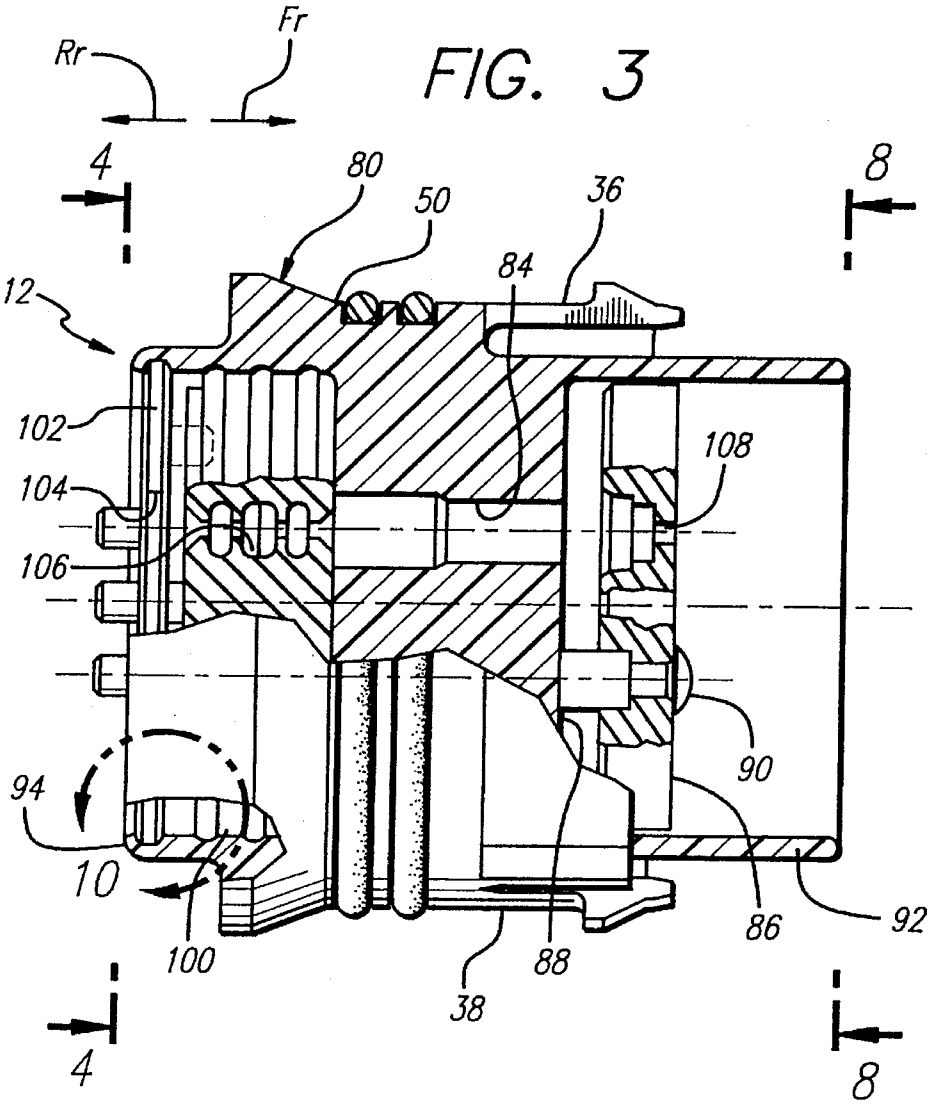
FIG. 3 is a partially sectional side view of the receptacle connector of FIG. 2, but without the contacts installed thereon.
Figure 4:
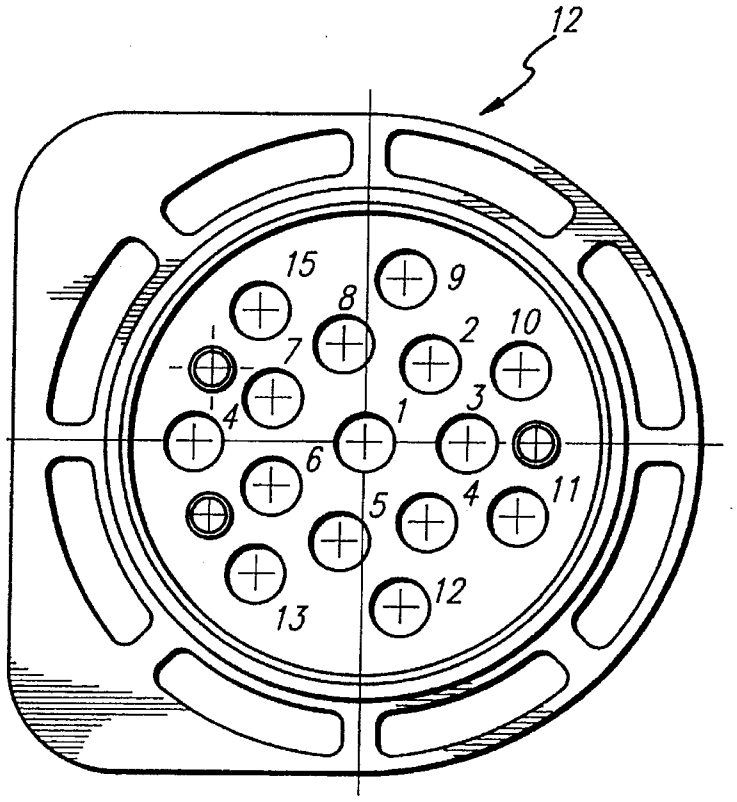
FIG. 4 is an end view taken on line 4—4 of FIG. 3.
Figure 6:
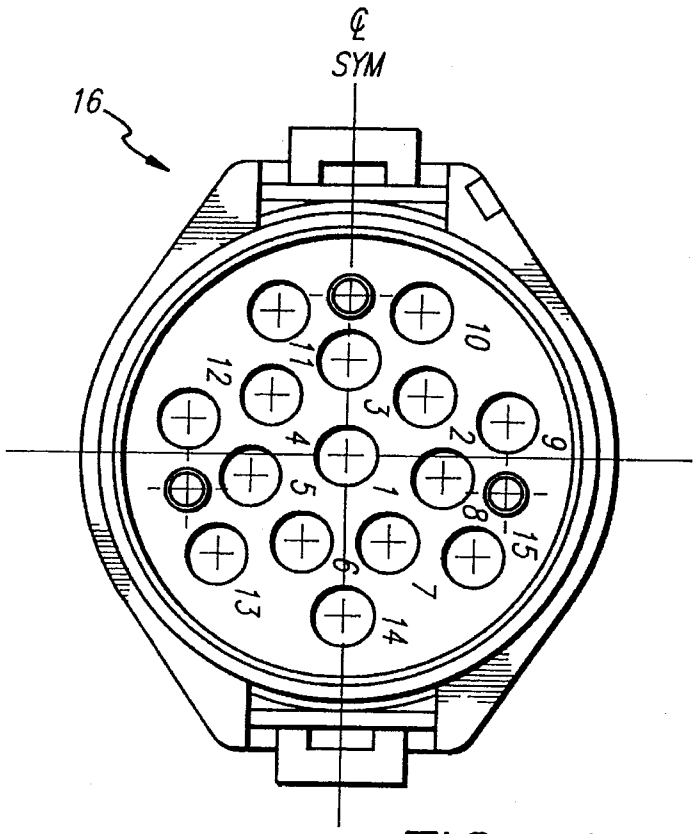
FIG. 6 is an end view taken on line 6—6 of FIG. 5.

FIG. 3 illustrates details of the first or receptacle connector 12, which includes the housing 80 that has the main housing portion 50. The housing 80 is molded of rigid insulative material, and includes the tines 36, 38 and contact receiving passages or holes 84 with contact keepers (not shown) at their front ends. A front insulator 86 lies forward (in direction Fr) of a housing middle insulator portion 88 and is fixed in position thereon by four stakes 90. The front insulator 86 lies within a hollow front end 92 of the connector housing. The connector housing also has a hollow rear end 94 that holds a soft rubber, or elastomeric grommet 100. A grommet retainer 102 lies rearward of the grommet. A pin contact (20 in FIG. 1) is installed in the connector 16 of FIG. 3, by moving the pin in the forward direction Fr through a retainer hole 104, an axially-extending grommet hole 106, a housing hole 84, and into a front insulator hole 108, until a flange 110 (FIG. 1) on the pin contact is retained by a keeper.

As shown in FIG. 2, each wire 22 passes through a retainer hole 104, which limits sideward deflection of the wire within the grommet 100. The retainer 102 is formed of rigid plastic, and initially lies a small distance rearward of the grommet rear end. When all of the wires of all of the connectors project through the grommet, and after the grommet soaks up liquid such as oil in an engine, the grommet expands. The grommet is restricted against radially outward expansion by the housing 80, but can expand in the rearward direction Rr. When the grommet expands, the retainer 102 supports the middle of the grommet to prevent a large rearwardly bulging middle from allowing the grommet to move out of the housing 80.

Figure 5:
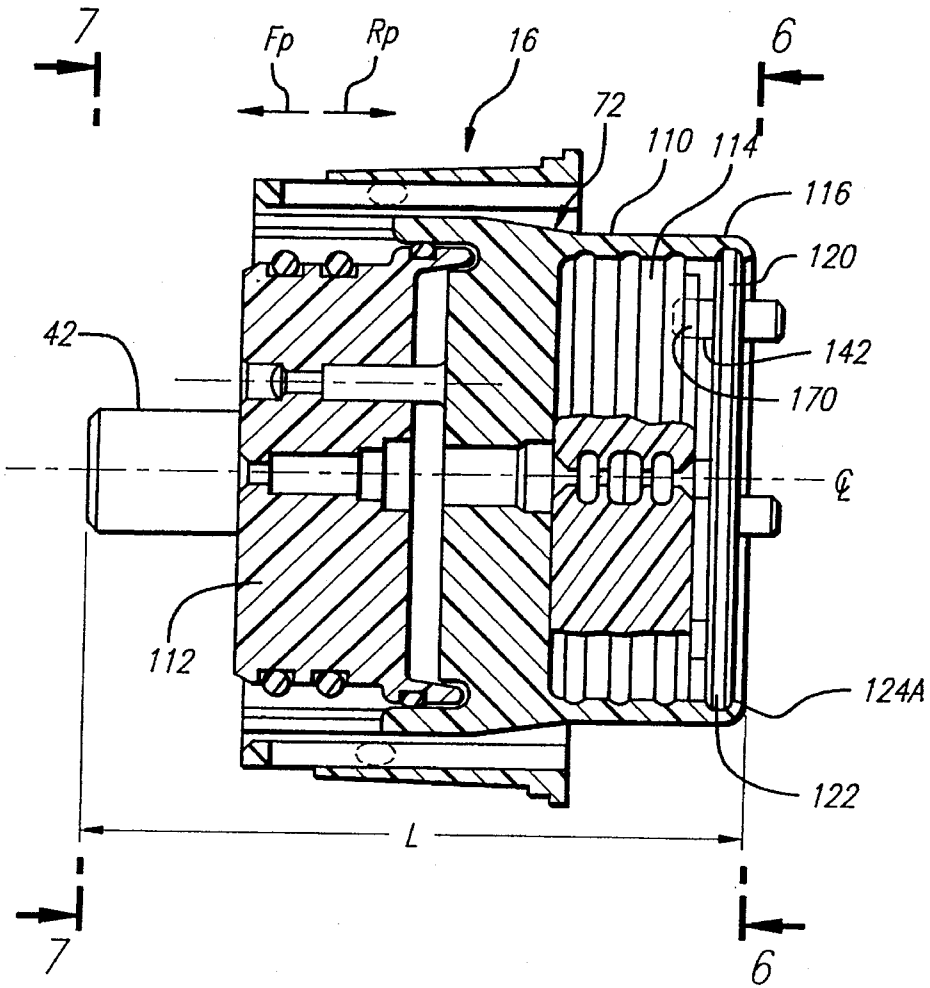
FIG. 5 is a sectional view of the plug connector of FIG. 2, but without the contacts installed thereon.

As shown in FIG. 5, the second or plug connector 16 is constructed in a manner similar to that of the first connector, with the second connector having a housing device or housing 110 that includes the main housing portion 72, with the wedges such as 42 being integral therewith. The second connector includes a front insulator 112 and includes a grommet device or grommet 114 held in a housing rear end 116. A grommet retainer or retainer device 120 lies in the housing rear end behind the groinmet 114, and serves the same purpose as the grommet retainer of the first connector.

Figure 10:
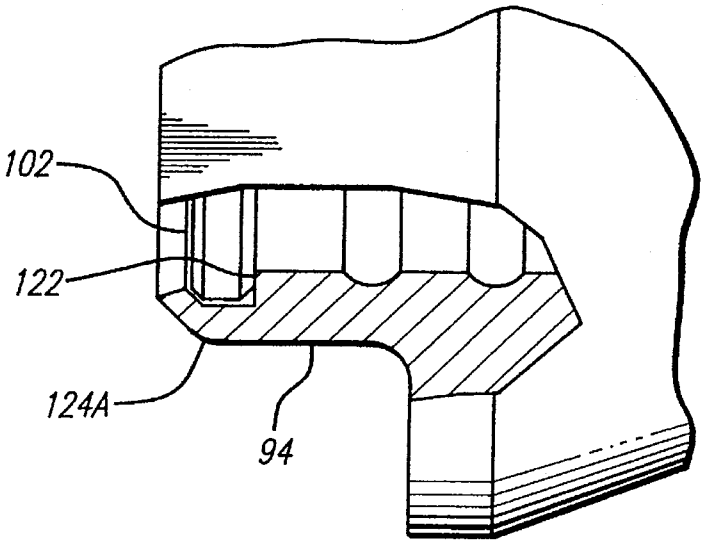
FIG. 10 is an enlarged view of the region 10—10 of FIG. 5.
Figure 9:
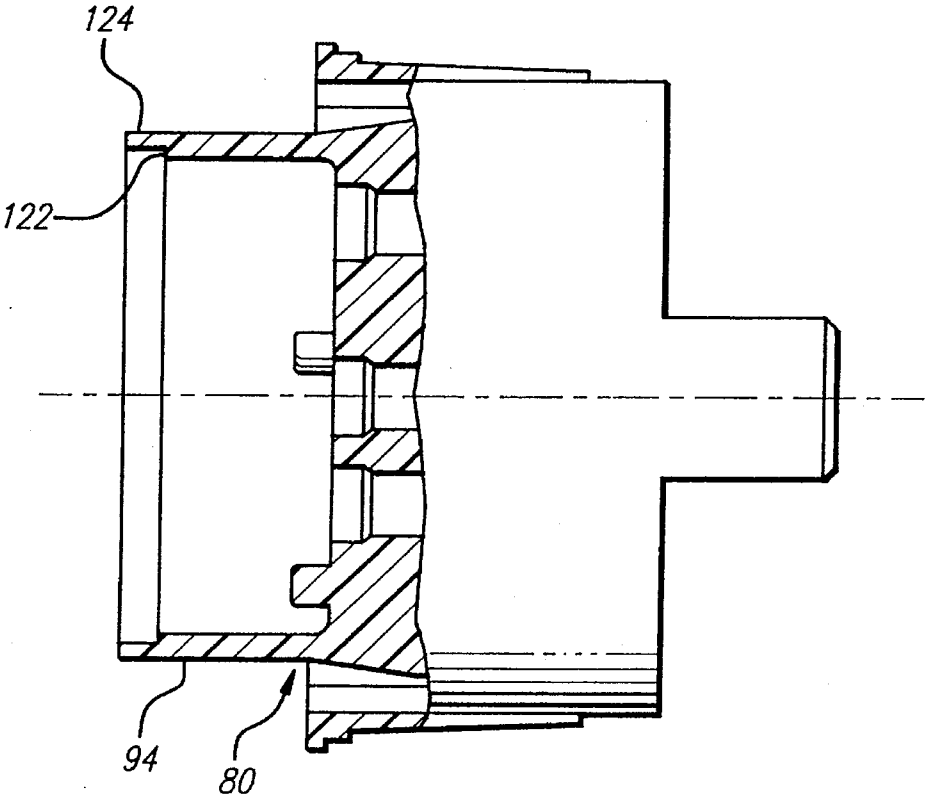
FIG. 9 is a sectional view of only the housing of the plug connector of FIG. 5, prior to installation of the retainer.

As shown in FIGS. 9 and 10, the rear 94 of the first connector housing 80 is initially formed with a rearwardly-facing shoulder 122 and with a wall 124 of reduced thickness extending rearward of the shoulder. After the grommet is installed, the grommet retainer is installed until it abuts the shoulder 122. The wall 124 is then heated and deformed radially inwardly by heat staking, to trap the grommet retainer in place. FIG. 10 shows the wall at 124A in its deformed configuration, wherein it traps the grommet retainer 102 between the shoulder 122 and the deformed wall 124A. FIG. 9 shows the wall 124 prior to deformation thereof.

Figure 11:
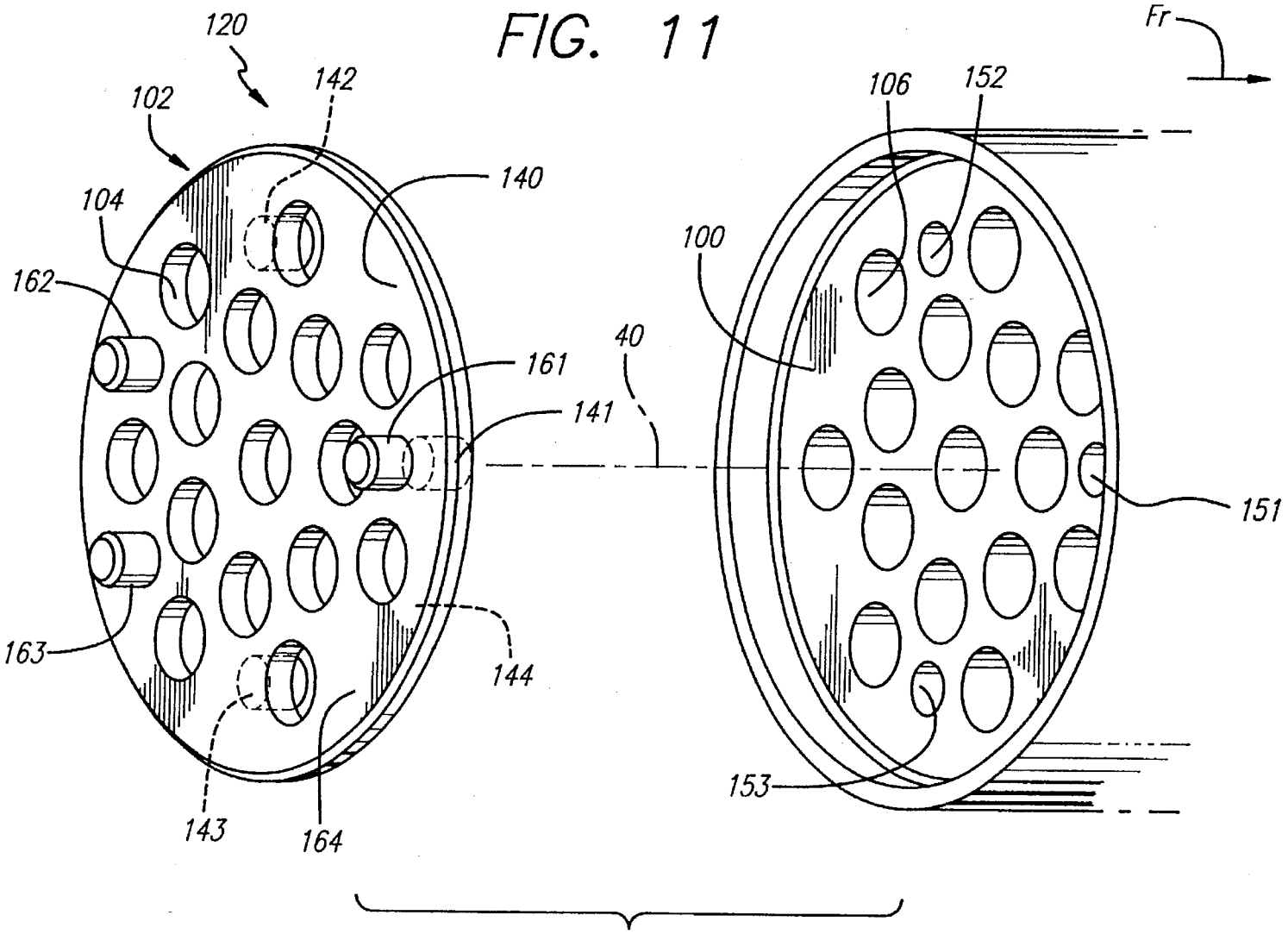
FIG. 11 is an exploded isometric view of the grommet retainer and a rear portion of the receptacle connector of FIG. 3.
Figure 14:
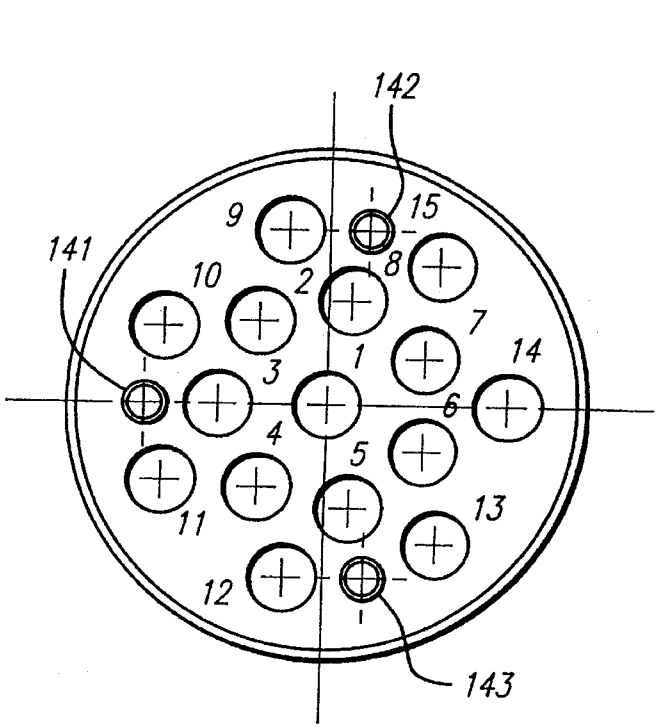
FIG. 14 is a front elevation view of the retainer of FIG. 12.
Figure 12:
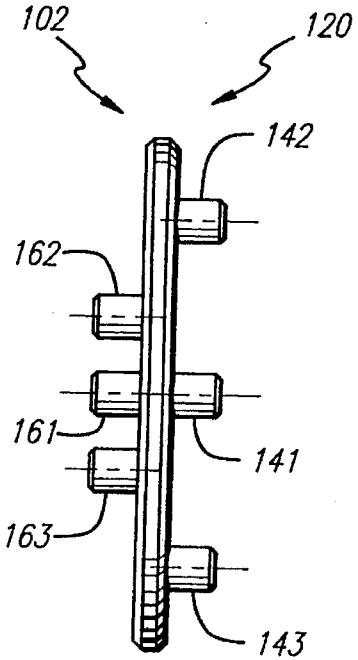
FIG. 12 is a side elevation view of the retainer of FIG. 11.
Figure 13:
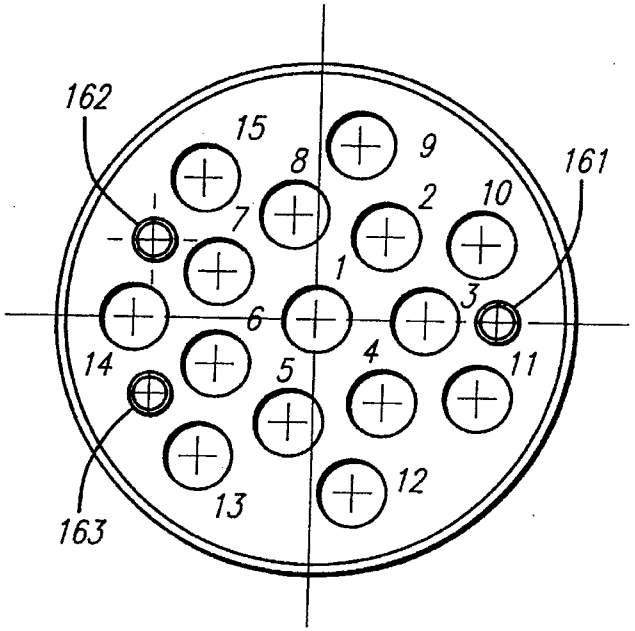
FIG. 13 is a rear elevation view of the retainer of FIG. 12.

As shown in FIG. 11, the retainer 102 has a plate-like portion 140 with wire-passing holes 104 therein, and has a plurality of bosses or posts 141, 142, 143 projecting in the forward direction Fr from the plate portion 140. The posts are received in corresponding post-receiving blind holes 151–153 in the grommet 100. The posts are preferably of a diameter to be closely received in the blind holes, but with a clearance around each post so it is substantially engaged with the grommet. The provision of the posts 141–143 that are received in the grommet holes 151–153, assures that the retainer 102 will be installed in the proper rotational orientation about the axis 40, to assure that all retainer holes 104 will be aligned with corresponding grommet holes 106. The presence of the posts 141–143 in the grommet holes 151–153, can also have a beneficial effect in controlling rearward expansion of the grommet.

Figure 8:
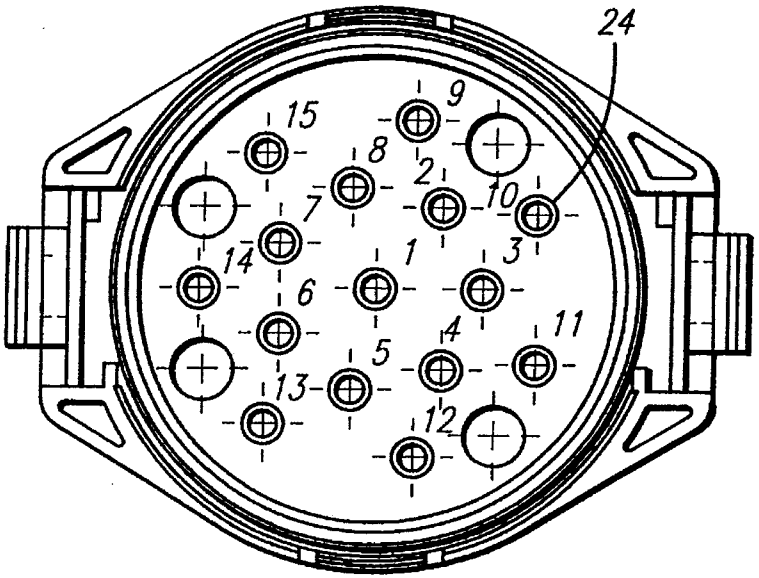
FIG. 8 is a front end view taken on line 8—8 of FIG. 3.
Figure 7:
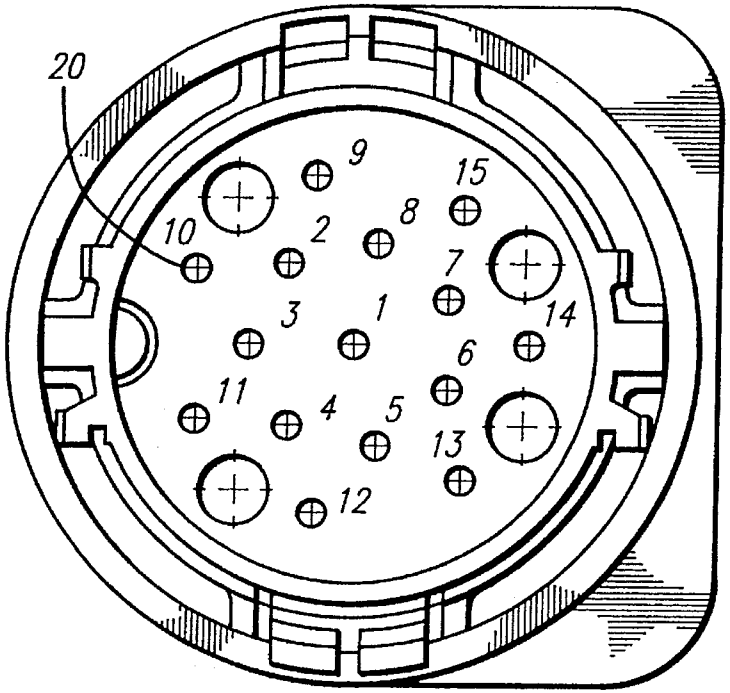
FIG. 7 is a front end view taken on line 7—7 of FIG. 5.

As shown in FIGS. 7 and 8, the arrangement of pin contacts 20 and corresponding socket contacts 24 are in patterns that are mirror images of each other. The same arrangements of wires and grommet holes are present at the rears of the connectors. As a result, applicant is able to use substantially identical retainers 102, 120 (FIG. 11) at the rear end of each connector 12, 14. However, the retainer must be oriented in a reverse direction when used for the first connector as when used for the second one. To this end, applicant provides a second pattern of posts 161, 162, 163 extending from a second face 164 of the plate-like portion 140. Also, the grommet 114 of the second connector is provided with blind holes such as 170 (FIG. 5) to receive the corresponding one of the second group of posts. The patterns of posts 141–143 (FIG. 11) on the first face 144 of the grommet retainer is different than the pattern of posts 161–163 on the second face 164. This prevents installation of the retainer in the reverse orientation. It is important to install the retainer in the proper orientation, because after the rear edge of a connector housing is heat deformed to fix the retainer in place, the retainer cannot be withdrawn to be reversed.

In a connector system that applicant designed for installation in a vehicle casing (where it is exposed to oil that swells the grommet), the first connector housing (80, FIG. 9) has an axial length L of 1.69 inch. All other dimensions are proportional as illustrated.

Thus, the invention provides a connector system and connectors thereof, which provide reliable retention of a first connector in a mounting wall, and which facilitate installation of a grommet retainer at the rear of a connector. A first connector is initially held in a mounting hole by tines that have latch parts at their front ends that form shoulders that abut a second face of the mounting wall. The second connector has wedges that move immediately radially inward of the tines to prevent radially inward movement of the tines when the connectors are mated. The elastomeric groinmet at the rear portion of each connector, is retained by a rigid retainer. The retainer has posts that project into blind holes in the grommets to assure proper rotational positioning of the retainer. The retainer can be fixed in place by heat staking a plastic, or polymer housing rear end which is formed with a shoulder to abut the front of the retainer. The retainer can have posts projecting from both of its faces, so the same retainer can be installed in either the plug or receptacle connector.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector having an axis, having a housing front insulator portion with a plurality of contact-receiving holes, and having an elastomeric grommet lying within said housing at a location rearward of said front insulator with said grommet having a plurality of axially-extending through holes for passing wires, characterized by:

a retainer mounted on said housing rearward of said grommet and having a plurality of retainer holes that can pass wires that extend through said grommet holes, said retainer having a plurality of forwardly projecting posts arranged in a first pattern;

said grommet has a rear end with a plurality of post-receiving holes arranged in said first pattern to receive said posts.

2. The connector described in claim 1 wherein:

said grommet retainer has a plurality of rearwardly projecting posts arranged in a second pattern that is different from said first pattern.

3. A connector system that includes first and second mateable connectors, where said first connector has a mateable front end which mates with said second connector, and where said first connector is designed to be mounted in a hole of a wall that has first and second opposite faces, characterized by:

said first connector has an axis extending in forward and rearward directions, a first main housing portion, and at least one tine that has a rear end fixed to said first main housing portion and a tine free forward end, with said tine forward end having a radially outwardly-extending latch part with a rearwardly facing shoulder for abutting said second face wherein said second face faces forwardly, and said first main housing portion forms a forwardly-opening wedge-receiving space on a radially inner side of said tine;

said second connector has a second main housing portion with a mating front end and has at least one wedge with a rear end fixed to said second main housing portion and projecting forwardly therefrom, with said wedge located to enter said wedge-receiving space and prevent inward deflection of said tine sufficiently for the shoulder thereof to move inwardly out of alignment with the second wall face.

4. The connector described in claim 3 wherein:

said first and second connectors have mating electrical contacts that mate as said connectors approach each other during mating;

said wedge extends sufficiently forward to lie directly inward of said tine before said contacts mate.

5. The connector described in claim 3 wherein:

said at least one tine comprises a plurality of tines spaced about said axis so at least two of said tines are spaced more than 90° apart around said axis and with a wedge-receiving space within each tine, and said second connector has a corresponding wedge each positioned to enter a corresponding one of said wedge-receiving spaces.

6. A method for assembling a connector which includes pressing an elastomeric grommet forwardly into an open rear end of a housing, characterized by:

forming said grommet with a plurality of wire-passing through holes and at least one post-receiving blind hole.

mounting a rigid grommet retainer on said housing at a location rearward of said grommet, with said retainer having a plate-like portion with a plurality of wire-passing holes aligned with said grommet through holes, and with said retainer having at least one forwardly-projecting post including inserting said post into said blind hole.

7. The method described in claim 6 wherein:

said step of mounting includes pressing said retainer against a rearwardly-facing shoulder on said housing, and radially inwardly deforming the extreme rear end of said housing against said retainer.

8. A method for mounting a first connector in a hole in a wall and for mating the first connector to a second connector, characterized by:

inserting the first connector in a first or forward direction along an axis, through said hole, until rearwardly facing shoulders at the free ends of each of a plurality of resilient tines snap to lie in front of said wall;

moving the second connector in a second direction that is opposite said first direction, toward said first connector, until wedges projecting in said second direction from said second connector each enter a space immediately radially inside one of said tines to prevent radially inward deflection of the corresponding tine, and moving said connector further in said second direction until electrical contacts of said connectors mate.

9. The connector described in claim 1 including:

a second connector device which is mateable with said connector, said second connector device having a housing device and having an elastomeric grommet device mounted in said housing device and having a grommet retainer device lying rearward of said grommet device;

said grommet device having a second pattern of post-receiving recesses which is different from said first pattern;

said grommet retainer device having a plate-like portion and a plurality of second posts arranged in said second pattern and received in said recesses of said grommet device;

said grommet retainer and grommet retainer device are substantially identical members, with each having said first posts arranged in said first pattern projecting from a first face of the member and having second posts arranged in said second pattern and projecting from a second face of the member.

* * * * *